United States Patent [19]

Godshalk et al.

[11] Patent Number: 4,488,670

[45] Date of Patent: Dec. 18, 1984

[54] CONTINUOUS FORM FEEDER

[75] Inventors: Russell L. Godshalk, Spencerport; Richard L. Bray, Churchville; Lawrence M. Wood, Spencerport, all of N.Y.

[73] Assignee: Eastman Kodak Company, Rochester, N.Y.

[21] Appl. No.: 464,292

[22] Filed: Feb. 7, 1983

[51] Int. Cl.[3] ..... B65H 25/24

[52] U.S. Cl. ..... 226/10; 226/24; 355/14 SH

[58] Field of Search ..... 226/24, 29, 30, 122, 226/10; 355/3 SH, 14 R, 14 SH, 14 CU; 270/51

[56] References Cited

U.S. PATENT DOCUMENTS

| | | | |
|---|---|---|---|
| 3,460,825 | 8/1969 | Mets et al. | 270/61 |
| 3,865,480 | 2/1975 | Swanberg | 355/3 R |
| 4,087,172 | 5/1978 | Van Dongen | 355/14 R |
| 4,264,200 | 4/1981 | Tickner et al. | 355/3 H |
| 4,299,477 | 11/1981 | Ward et al. | 355/14 R |
| 4,313,672 | 2/1982 | Scroeder et al. | 355/14 R |
| 4,320,960 | 3/1982 | Ward et al. | 355/14 R |
| 4,334,764 | 6/1982 | Rawson et al. | 355/14 SH |
| 4,406,389 | 9/1983 | Mowry, Jr. | 226/29 |

FOREIGN PATENT DOCUMENTS

| | | |
|---|---|---|
| 245947 | 1/1926 | United Kingdom . |
| 401538 | 11/1933 | United Kingdom . |
| 435376 | 9/1935 | United Kingdom . |
| 501872 | 3/1939 | United Kingdom . |
| 702603 | 1/1954 | United Kingdom . |
| 821685 | 10/1959 | United Kingdom . |
| 869891 | 6/1961 | United Kingdom . |
| 885687 | 12/1961 | United Kingdom . |
| 887324 | 1/1962 | United Kingdom . |
| 1185251 | 3/1970 | United Kingdom . |
| 1269419 | 4/1972 | United Kingdom . |
| 1508810 | 4/1978 | United Kingdom . |

*Primary Examiner*—Leonard D. Christian

*Attorney, Agent, or Firm*—Larry P. Kessler

[57] ABSTRACT

A continuous forms feeder in which the restacking of the continuous forms is facilitated. Panels of the continuous forms are sequentially fed at a predetermined linear speed from a stack in a supply station through a work station, such as a print or exposure station of a reproduction apparatus, to a storage station. During the movement of the first several panels through the work station, the linear speed is reduced relative to the predetermined linear speed to provide more time for effecting proper restacking of the continuous forms in the storage station.

6 Claims, 3 Drawing Figures

CONTINUOUS FORM FEEDER

BACKGROUND OF THE INVENTION

This invention relates generally to continuous forms feeders, and more particularly to a continuous forms feeder in which restacking of the continuous forms is facilitated.

It is common practice to print computer information output on a continuous run of paper. Such paper is typically an elongated web divided into uniform lengths, or panels, in the longitudinal direction, by transverse weakening lines formed for example by perforations. The web is stored as a stack by folding the web along the weakening lines with alternate lines forming opposing edges of the stack. This is commonly referred to as fan fold paper.

In printing computer information output on a web, the web is fed from the stack to a line or page printer where it is imprinted and then discharged into a receptacle in a manner to reform the stack. Duplicates of selected panels of the stack can be made by dividing the web into individual sheets by separating the web along the weakening lines and copying the selected sheets. Alternatively, the entire stack can be duplicated by feeding the web from the stack by a conveyor to a reproduction apparatus for copying and discharging the web into a receptacle in a manner to reform the stack (see, for example, U.S. Pat. Nos. 4,087,172, issued May 2, 1978 in the name of VanDongen, or 4,264,200, issued Apr. 28, 1981 in the names of Tickner et al).

When either printing on the web or duplicating the information on the web, with the web intact, there is a problem in reforming the web into a stack. As the web enters the discharge receptacle, the operator must assist the start of the restacking process to insure that the folding along the weakening lines occurs in the proper orientation. Otherwise the stack may have an improper orientation (i.e., imprinted information side of web does not face reader) or may not restack at all. With high speed printers or duplicators, the problem of assisting proper restacking is compounded because the web travel speed does not allow the operator sufficient time to manually assist the restacking process.

SUMMARY OF THE INVENTION

This invention is directed to a continuous forms feeder in which the restacking of the continuous forms is facilitated. Panels of the continuous forms are sequentially fed at a predetermined linear speed from a stack in a supply station through a work station, such as a print or exposure station of a reproduction apparatus, to a storage station. During the movement of the first several panels through the work station, the linear speed is reduced relative to the predetermined linear speed to provide more time for effecting proper restacking of the continuous forms in the storage station.

The invention, and it objects and advantages, will become more apparent in the detailed description of the preferred embodiment presented below.

BRIEF DESCRIPTION OF THE DRAWINGS

In the detailed description of the preferred embodiment of the invention, reference is made to the accompanying drawings, in which.

DESCRIPTION OF THE PREFERRED EMBODIMENT

Figure 1:
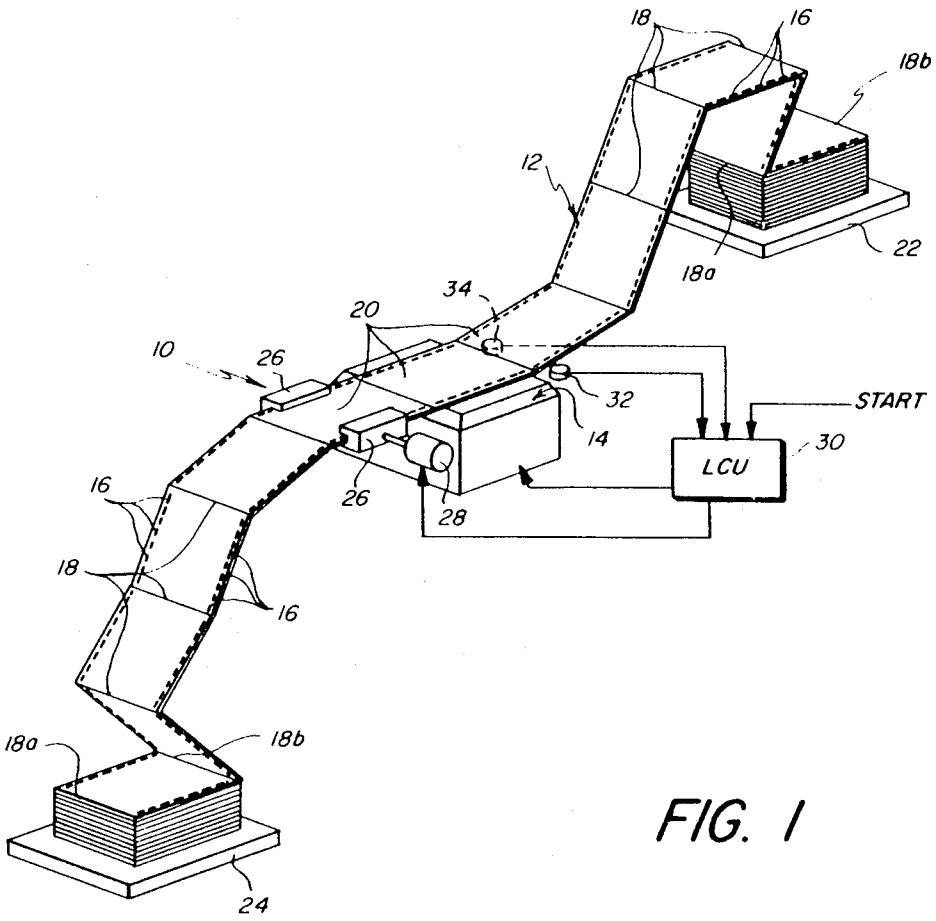
FIG. 1 is a schematic illustration of a continuous forms feeder, associated with a work station, in which forms restacking is facilitated in the manner according to this invention.

Referring now to the accompanying drawings, FIG. 1 schematically represents a continuous forms feeder 10 for feeding continuous forms 12 through a work station 14. The continuous forms 12 is a web of paper, typically having lateral marginal edge perforations 16 and spaced transverse weakening lines 18. The weakening lines 18 enable the web to be fan folded into a series of panels 20 in a compact stack with alternating weakening lines forming transverse marginal edges 18*a*, 18*b* of the stack. The stack, supported in a supply station on platform 22, is directed panel by panel by the feeder 10 in operative relation with the station 14, and restacked in a storage station on receptacle platform 24.

The continuous forms feeder 10 includes, for example, a pair of tractor assemblies 26 such as shown in U.S. Pat. No. 3,606,122 issued Sept. 20, 1971 in the names of Brewster et al. The tractor assemblies 26 are driven by a motor 28 and have pins which engage the edge perforations 16 to feed the continuous forms 12 along a travel path from platform 22 to platform 24 at a predetermined linear speed. Of course, the continuous forms 12 may be stopped at the work station, or may have a travel speed through the work station different from its speed when fed to or away from such station. Therefore, the term "predetermined linear speed" as used with regard to this invention is an average travel speed defined in terms of the distance between platforms 22 and 24 divided by the total time it takes for a panel of the continuous forms to traverse such distance under steady state operation including the time required to perform the function of the work station on each panel. The work station 14, as shown in FIG. 1 is the platen of a reproduction apparatus for copying information contained on the panels 20 of the continuous forms 12 stopped respectively on the platen. Alternatively, the work station is, for example, a line or page printer for producing computer generated information on the panels.

The feeder 10 and the work station 14 are operatively coupled to a logic and control unit 30 which includes a digital processor, such as a microprocessor. The unit 30 is also coupled to sensor 32 for detecting travel of the continuous forms 12 along its travel path. The sensor 32 is, for example, a photoelectric device adjacent to an edge of the travel path of the forms 12 producing timing signals based upon detection of the perforations 16 passing over the sensor. In response to such signals and a stored program in the microprocessor, the unit 30 produces signals to control the timing of operation of the feeder 10 and the station 14. The production of a program for a number of commercially available microprocessors such as INTEL Model 8080 or Model 8085 microprocessor (which along with others are suitable for use with this invention), is a conventional skill well understood in the art. The following disclosure is written to enable a programmer having ordinary skill in the art to produce an appropriate control program for the microprocessor incorporating the sequence for facilitating restacking according to this invention. The particular details of such program would, of course, depend on the architecture of the designated microprocessor.

Figure 2:
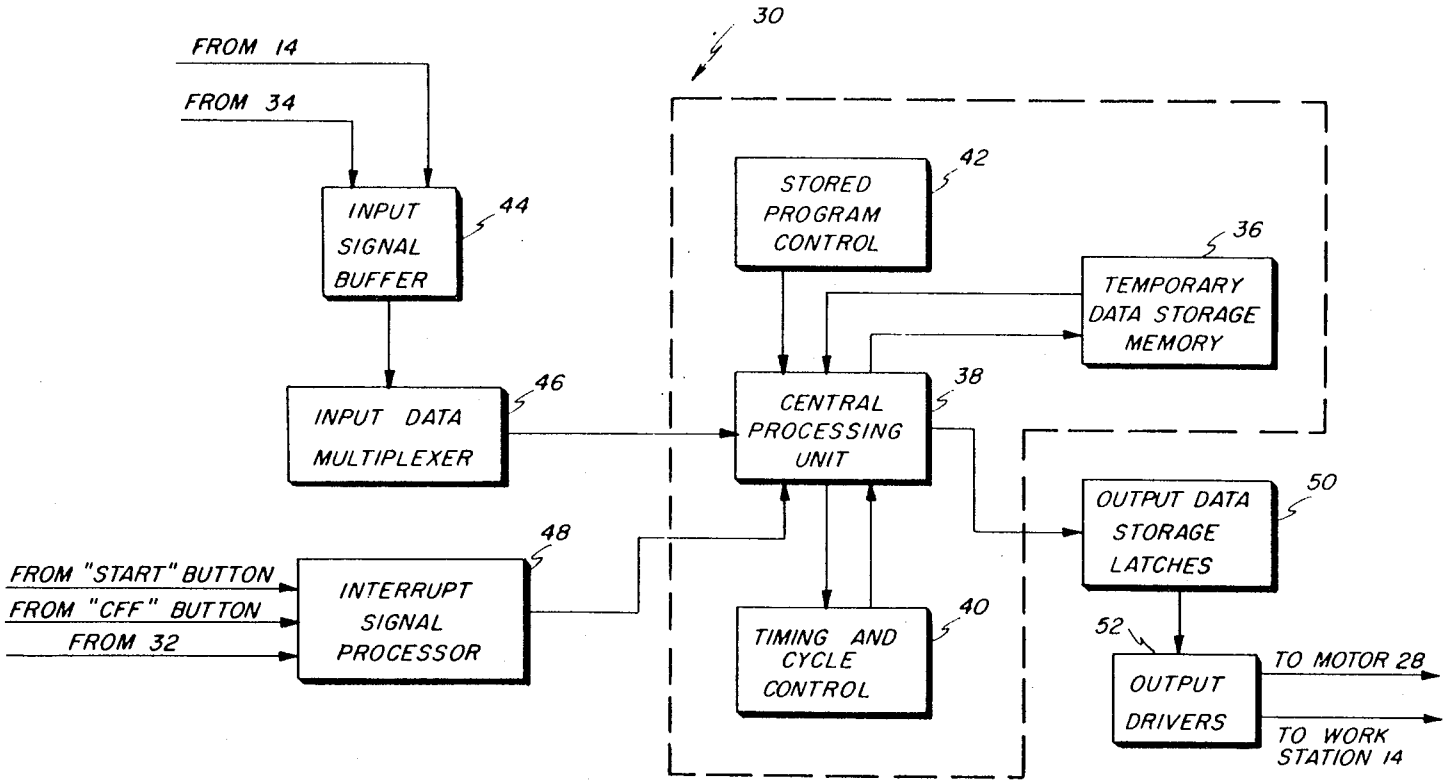
FIG. 2 is a block diagram of the logic and control unit of FIG. 1.

As shown in the block diagram of FIG. 2, the logic and control unit 30 includes a temporary data storage memory 36, central processing unit 38, timing and cycle control unit 40, and stored program control unit 42. Data input and output is performed sequentially under program control. Input data are supplied either through input signal buffer 44 to a multiplexer 46, or to an interrupt signal processor 48. The input data signals to the buffer 44 are derived from work station 14, in response to its operation, and a last panel sensor 34 (described hereinafter). The input data signals to the interrupt signal processor 48 are derived from an operator control panel (not shown), having "start" and "continuous forms feeder (CFF)" signal buttons, and from the sensor 32. The output data and control signals are applied to storage latches 50 which provide inputs to suitable output drivers 52 operatively coupled to the motor 28 for the tractor assemblies 26 and to the work station 14.

Figure 3:
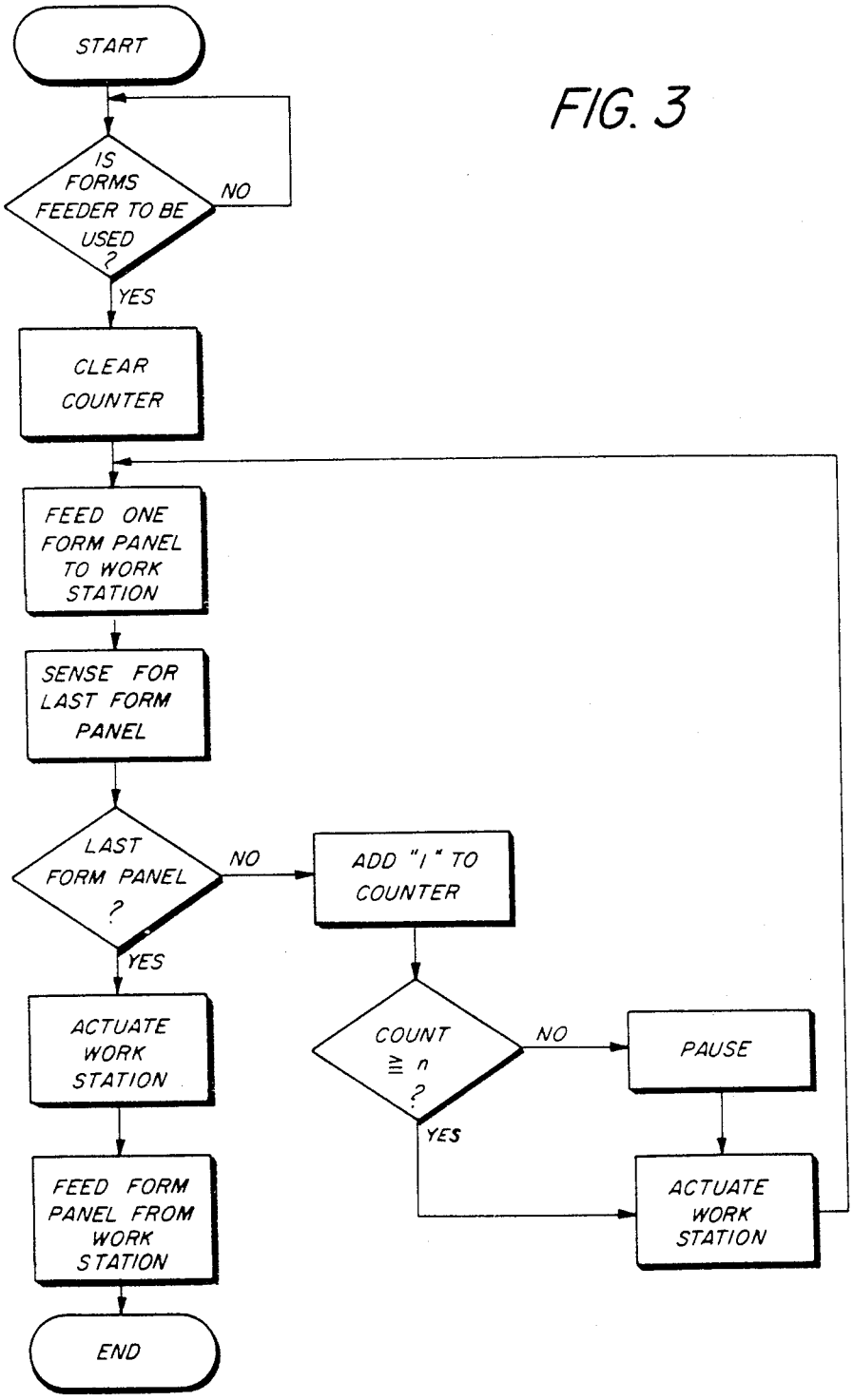
FIG. 3 is a flow chart for operation of the continuous forms feeder according to this invention.

The stored program control unit 42 includes one or more conventional Read Only Memories (ROM) containing the operational program, depicted in the flow chart of FIG. 3, for operating the continuous forms feeder 10 according to this invention. The program is in the form of binary words corresponding to the program instructions and values. This program is permanently stored in the ROM and cannot be altered. The temporary data storage memory 36 includes a conventional Read/Write memory or Random Access Memory (RAM) which serves as a counter.

To set up the continuous forms feeder 10 for use, the first panel of continuous forms 12 is inserted in the tractor assemblies 26. If the first panel contains information to be reproduced, such panel is first manually placed on the work station 14, and the work station is actuated to expose the panel to enable such reproduction to be made. Additionally, if the dimension of the panels between weakening lines 18 is such that more than just the first panel extends beyond the station into the tractor assemblies, and such panels contain information to be reproduced, such panels are similarly placed on the work station and exposed to enable such reproductions to be made.

When the first panel is properly engaged in the tractor assemblies 26 and the central processing unit 38 of the logic and control unit 30 is in an initialized condition, the "start" signal button on the operator control panel is actuated and an appropriate signal transmitted through the interrupt signal processor unit 48 to the central processing unit 38 to initiate the program. At the initiation of the program, a check is performed to see if the continuous forms feeder 10 is to be used. This check is provided by determining if the "CFF" signal button has been actuated and an appropriate signal transmitted through the unit 48 to the unit 38.

If the feeder 10 is to be used, a particular memory location of the temporary data storage memory 36 is cleared. The central processing unit 38 then generates a signal applied to latches 50 to provide inputs to the output drivers 52 to actuate the motor 28 to drive the tractors 26 and feed one panel 20 to the work station 14 at the predetermined linear speed. In order to feed only one panel, sensor 32 counts, for example, the number of perforations 16 from a weakening line 18 and provides appropriate signals through the unit 48 and the central processing unit 38 to a memory location in temporary data storage memory 36 (other than the aforementioned particular memory location). When such count equals a preprogrammed number (stored in the unit 42) for a particular panel dimension in the direction of travel, the unit 38 applies a signal to latches 50 to provide input to output drivers 52 and deactuate motor 28.

As the one panel is being fed by tractor assemblies 26, a sensor 34 (similar to sensor 32, for example), adjacent to the station 14 and transversely spaced from the edge of the continuous forms 12, looks for the last panel of the continuous forms; i.e., it detects the absence of a panel following the last panel. If the last panel is not detected, a signal of a first level (e.g., low) is sent from sensor 34 through buffer 44 and multiplexer 46 to unit 38 and a "1" is added to the aforementioned particular memory location of memory 36 after each panel is fed. In this manner the number of fed panels is accummulated and stored in such memory location. Such number is compared in the central processing unit 38 with a preselected number stored in unit 42 to determine if such number is equal to or greater than such preselected number. If such number is not equal to or greater than the preselected number, the central processing unit 38 will generate a pause in the program for a predetermined time interval before applying a signal to the latches 50 to provide an input to the output drivers 52 to actuate the work station 14 (in this example, exposing the panel for reproducing the information contained thereon).

On the other hand, if such number is equal to or greater than the preselected number, the unit 38 immediately applies a signal to the latches to provide an input to the output drivers to actuate the work station. After the station 14 performs its function, it sends a signal through buffer 44 and multiplexer 46 to unit 38 to cause the unit to repeat the steps of the program from the step of feeding of one panel to the work station 14. By an alternate set of steps for a portion of the program, the actuation of the work station 14 could occur immediately after the counted number is compared to the preselected number, with the program pause occurring for a predetermined time interval before the feed of the next panel when such number is not equal to or greater than the preselected number.

With the described program steps, the effective rate of movement (average linear speed) of the continuous forms 12 for the first several panels is substantially slowed, with respect to the predetermined linear speed, until the number of panels acted upon in the work station 14 is equal to or greater than the preselected number. Therefore, the operator has a relatively extended period of time to manually assist the folding of the continuous forms to accomplish proper restacking of such forms on the platform 24. As an illustrative example, if the period of time between actuations of the motor 28 for effecting feed of sequential panels to the work station is normally 1.75 seconds, the predetermined time interval of the pause is conveniently set at 1.75 seconds. This halves the average linear speed of movement of the continous forms 12 with respect to the predetermined linear speed. The preselected number is selected so as to enable a sufficient number of panels to reach the platform 24 and be restacked. Such number is dependent upon the distance between the work station 14 and platform 24 and the dimension of the panels in the direction of travel. In the illustrative embodiment such number is 7. Thus the operator has approximately 12.25 seconds in which to manually assist folding of the continuous forms to facilitate restacking, during which time the average linear speed of the continuous forms is approximately 50% of the predetermined linear speed.

After the panel count number is equal to or greater than the preselected number, the steps of the program are repeated to feed the continuous forms in a steady state operation at the predetermined linear speed until the sensor 34 detects the last panel. When such last panel is detected, a signal of a different level (e.g., high) is sent through buffer 44 and multiplexer 46 to central processing unit 38 to indicate such detection. The program, from unit 42, then has the unit 38 produce a signal applied to the output latches 50 to provide the input for the ouput drivers 52 to actuate the work station 14 and then the motor 28 to feed the last panel to the platform 24. After the panel is fed to the platform 24 (and restacking is completed) the program ends; i.e., the motor 28 and work station 14 are deactuated, and the logic and control unit 30 returns to its initialized condition to await a new "start" signal.

The invention has been described in detail with particular reference to a preferred embodiment thereof, but it will be understood that variations and modifications can be effected within the spirit and scope of the invention.

I claim:

1. In a continuous forms feeder having means for engaging seriatim the panels of a continuous form to move the panels at a predetermined speed along a path from a stack in a supply station through a work station to a storage station in which the continuous form is restacked, the improvement comprising:

means for counting the panels of the continuous forms; and means responsive to said panel counting means and operatively associated with said engaging means for reducing the speed of panel movement below said predetermined speed during the movement of the first several panels of the continuous forms through said work station to provide more time for effecting proper restacking in the storage station.

2. Apparatus for feeding continuous forms from a stack through a work station, selectively operable on panels of such continuous forms, to a receptacle in which the continuous forms are restacked, said apparatus comprising:

means for sequentially feeding, at a predetermined linear speed, panels of the continuous forms from such stack through such work station;

means for counting the number of panels fed by said feeding means and accumulating such count;

means for comparing such accumulated count with a preselected number; and means, effective when such accumulated count is less than said preselected number, for delaying the feeding of the next panel for a preselected time interval, to reduce the effective linear speed of such continuous forms with respect to said predetermined linear speed, whereby proper restacking of such continuous forms discharged to such receptacle is facilitated.

3. In feeding continuous forms from a stack at a predetermined linear speed from a stack through a work station, selectively operable on panels of such continuous forms, to a receptacle in which the continuous forms are restacked, an improved method for facilitating restacking of such continuous forms in such receptacle comprising the steps of:

counting the panels of such continuous forms; and reducing the speed of movement of such continuous forms, during movement of the first several panels through the work station, below the predetermined linear speed to provide more time for effecting restacking of the continuous forms in such receptacle.

4. The invention of claim 3 wherein the speed of movement of such continuous forms is reduced to approximately one-half such predetermined speed.

5. The invention of claim 4 wherein the speed of movement of such continuous forms is reduced during movement of approximately the first seven panels.

6. A method for feeding continuous forms from a stack through a work station, selectively operable on panels of such continuous forms, to a receptacle in which the continuous forms are restacked, comprising the steps of:

feeding, at a predetermined linear speed, a panel of the continuous forms from such stack through such work station;

counting the number of fed panels, and when the accumulated count is less than a preselected number, delaying the feeding of the next panel of such continuous forms for a preselected time interval, whereby the effective linear speed of such continuous forms discharged to the receptacle is substantially less than such predetermined linear speed to facilitate proper restacking of such continuous forms.

* * * * *